US006514096B1

(12) United States Patent
Liu

(10) Patent No.: US 6,514,096 B1
(45) Date of Patent: Feb. 4, 2003

(54) WATERPROOF STRUCTURE OF A ROPE LIGHT

(76) Inventor: Tzu-Chen Liu, P.O. Box No. 6-57, Chung Ho, Taipei 235 (TW)

( * ) Notice: Subject to any disclaimer, the term of this patent is extended or adjusted under 35 U.S.C. 154(b) by 0 days.

(21) Appl. No.: 09/991,685

(22) Filed: Nov. 26, 2001

(51) Int. Cl.[7] ..... H01R 13/62
(52) U.S. Cl. ..... 439/320
(58) Field of Search ..... 439/320–323, 439/283, 278, 281; 362/240

(56) References Cited

U.S. PATENT DOCUMENTS 3,489,987 A * 1/1970 Niskin ..... 439/283
5,454,728 A * 10/1995 Jack ..... 439/320
5,649,835 A * 7/1997 Weed ..... 439/320
5,762,510 A * 6/1998 Taniguchi et al. ..... 439/320
5,971,786 A * 10/1999 Beck ..... 439/320

* cited by examiner

*Primary Examiner*—Gary Paumen

(57) ABSTRACT

A waterproof structure of a rope light includes a positive joint of a rope light, a negative joint of an electric cord and a nut; wherein, a V-shaped slot on a circumferential rim of a bottom portion of a jointing plane inside a positive joint of the rope light joints correspondingly with a cone-shaped head on a circumferential rim of a bottom portion of a jointing plane of a negative joint of the electric cord; in addition, a convex retaining ring disposed at a proper area of the negative joint of the electric cord tightly retains with a concave groove retaining ring disposed on the jointing plane inside the positive joint of the rope light to prevent liquid permeation, such as water, and to eliminate the short circuit and damage of the rope light so as to achieve the economic efficiency of being more convenient and safe.

1 Claim, 3 Drawing Sheets

WATERPROOF STRUCTURE OF A ROPE LIGHT

BACKGROUND OF THE INVENTION

1. Field of the Invention

The present invention relates to a waterproof structure of a rope light, more especially to a structure capable of facilitating the assembly, reinforcing the waterproof effect to prevent liquid permeation, such as water, and eliminating the short circuits and damage of the rope light so as to achieve the economic efficiency of being more convenient and safe.

2. Description of the Prior Art

Accordingly, the central area of a positive joint of a conventional rope light is disposed concavely and the central area of a negative joint of an electric cord is disposed convexly; both of them are jointed correspondingly; since most of the jointed planes between them are in the shapes of horizontal planes, after jointing, the jointed area is left with a gap and liquid such as the rain water tends to permeate and result in light bulb short circuit and damage; therefore, in order to prevent liquid permeation, some of the industrials added a waterproof washer to the jointed area of the positive joint of the rope light and the negative joint of the electric cord, then screwed it fixedly with a nut; although the waterproof washer is capable of preventing liquid permeation, such as water; however, being made of rubber, after a long term of use, its quality tends to change after being affected by the temperature change of heat expansion and cold contraction such that its waterproof effect will thereby be reduced; furthermore, weather the waterproof washer can achieve a normal effect is due to the tightness of the nut which is resulted from human factors.

According to the abovementioned, in order to solve the shortcomings of the waterproof washer and to replace it, some of the industrials spread the waterproof glue onto the jointed area between the positive joint of the rope light and the negative joint of the electric cord; however, the material cost thereof is too high and both the assembly and the disassembly are inconvenient and time-consuming thereby limiting the economic efficiency is limited.

In view of the mentioned shortcomings and the inconveniences of the facility of the conventional rope light, the inventor of the present invention based on the spirit of searching for and inventing the best as well as his professional perspective and knowledge, searched and designed a more feasible waterproof structure of a rope light with a wider application scope to meet more industrial utilizing value.

SUMMARY OF THE INVENTION

The present invention comprises a positive joint of a rope light, a negative joint of an electric cord and a nut; wherein a V-shaped slot on a circumferential rim of a bottom portion of a jointing plane inside a positive joint of the rope light joints correspondingly with a cone-shaped head on a circumferential rim of a bottom portion of a jointing plane of a negative joint of the electric cord; in addition, a convex retaining ring disposed at a proper area of the negative joint of the electric cord tightly retains with a concave groove retaining ring disposed on the jointing plane inside the positive joint of the rope light; furthermore, a nut inserted on the negative joint of the electric cord screws fixedly with the screw threads disposed on the outer rim of the positive joint of the rope light; all of the respectively jointed and fixedly screwed jointing planes of the positive joint of the rope light, the negative joint of the electric cord and the nut are beveled shapes.

The primary objective of the present invention is to use the abovementioned the structural design of jointing and fixedly screwing the positive joint of the rope light, the negative joint of the electric cord and the nut to replace the use of the waterproof washer so as to make the assembly more convenient, time-saving and reinforce the waterproof effect.

To enable a further understanding of the structural features and the technical contents, the brief description of the drawings below is followed by the detailed description of the preferred embodiment.

DETAILED DESCRIPTION OF THE PREFERRED EMBODIMENTS

Figure 1:
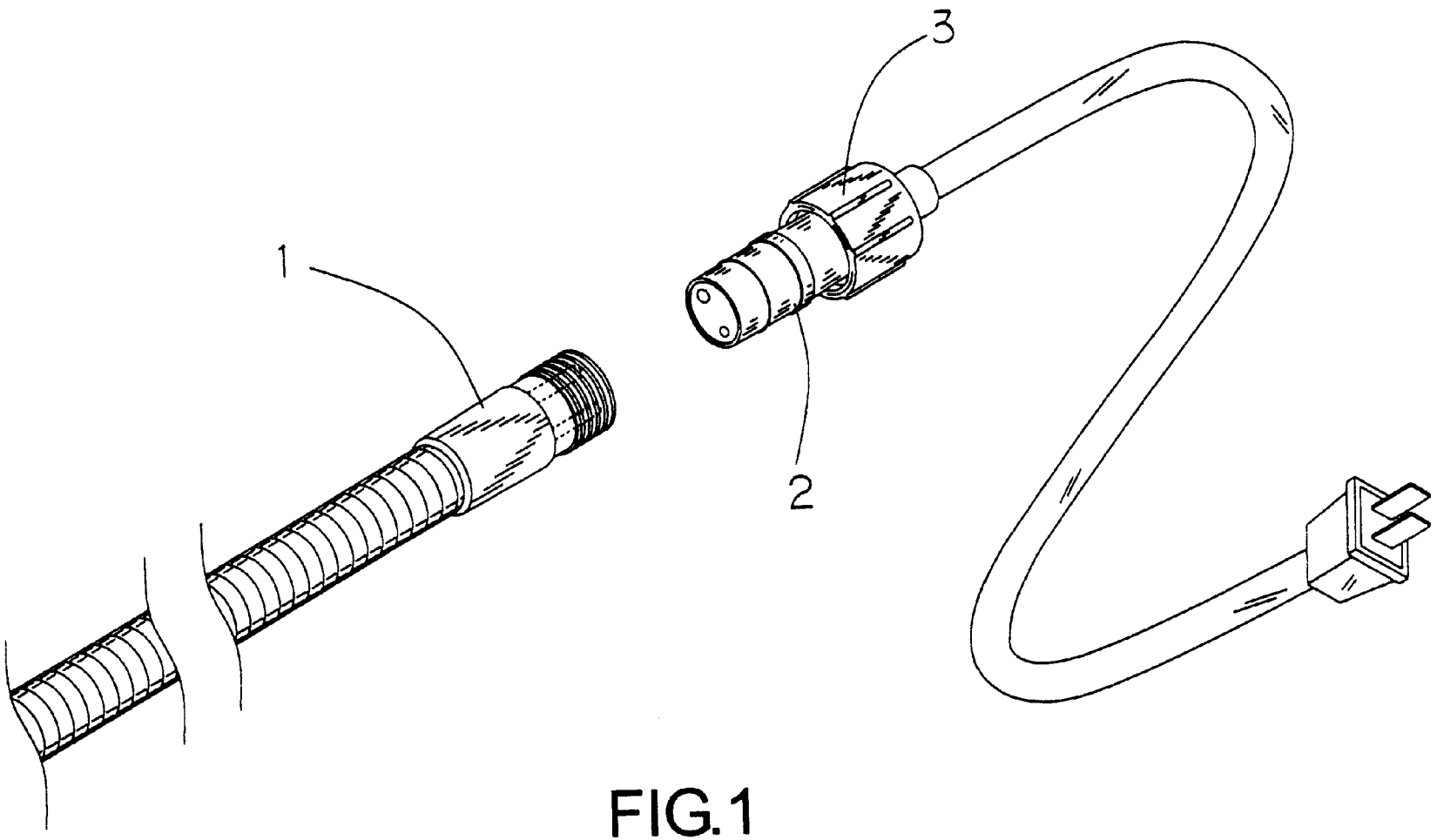
FIG. 1 is a pictorial and exploded drawing of the present invention.

Referring to FIG. 1, the pictorial and exploded drawing of the present invention, the present invention comprises a positive joint (1) of a rope light, a negative joint (2) of an electric cord and a nut (3) respectively jointed and fixedly screwed together.

Figure 2:
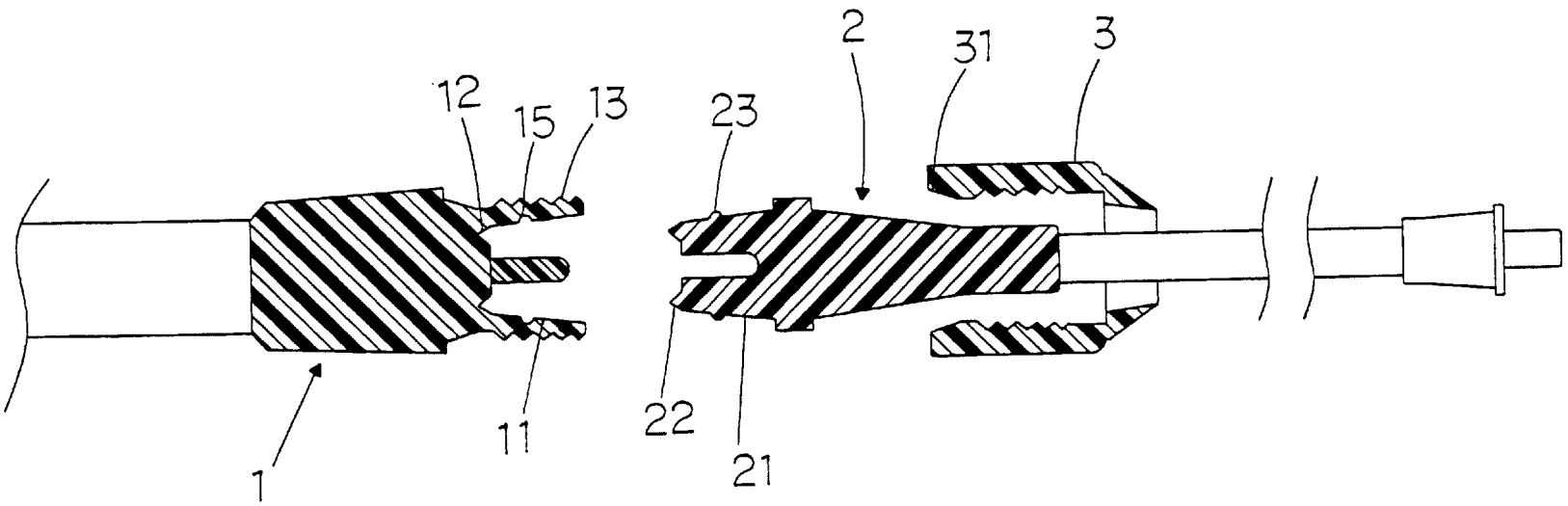
FIG. 2 is a schematic, cross-sectional, lateral view and exploded drawing of the present invention.

FIG. 2 shows the schematic, cross-sectional, lateral view and exploded drawing of the present invention. The present invention reinforces the waterproof effect of the joint between the positive joint (1) of the rope light and the negative joint (2) of the electric cord; the features of the present invention include that screw threads (13) are disposed on the outer rim of the positive joint (1) of the said rope light; a V-shaped slot (12) disposed concavely on the circumferential rim of the bottom portion of a jointing plane (11) inside a positive joint (1) of the rope light joints correspondingly with a cone-shaped head (22) disposed convexly on the circumferential rim of the bottom portion of a jointing plane (21) of a negative joint (2) of the electric cord; in addition, a convex retaining ring (23) disposed at a proper area of the negative joint (2) of the electric cord tightly retains with a concave groove retaining ring (15) disposed on the circumferential rim of the jointing plane (11) inside the positive joint (1) of the rope light; furthermore, a nut (3) inserted on the negative joint (2) of the electric cord screws fixedly with the screw threads (13) disposed on the outer rim of the positive joint (1) of the rope light to prevent liquid permeation, such as water, and to eliminate the short circuit and damage of the rope light; all of the respectively jointed and fixedly screwed jointing planes (11, 21, 31) of the positive joint (1) of the rope light, the negative joint (2) of the electric cord and the nut (3) are of beveled shapes [so as to facilitate] thereby facilitating the assembly and the waterproof effect so as to achieve the economic efficiency of being more convenient and safe.

Figure 3:
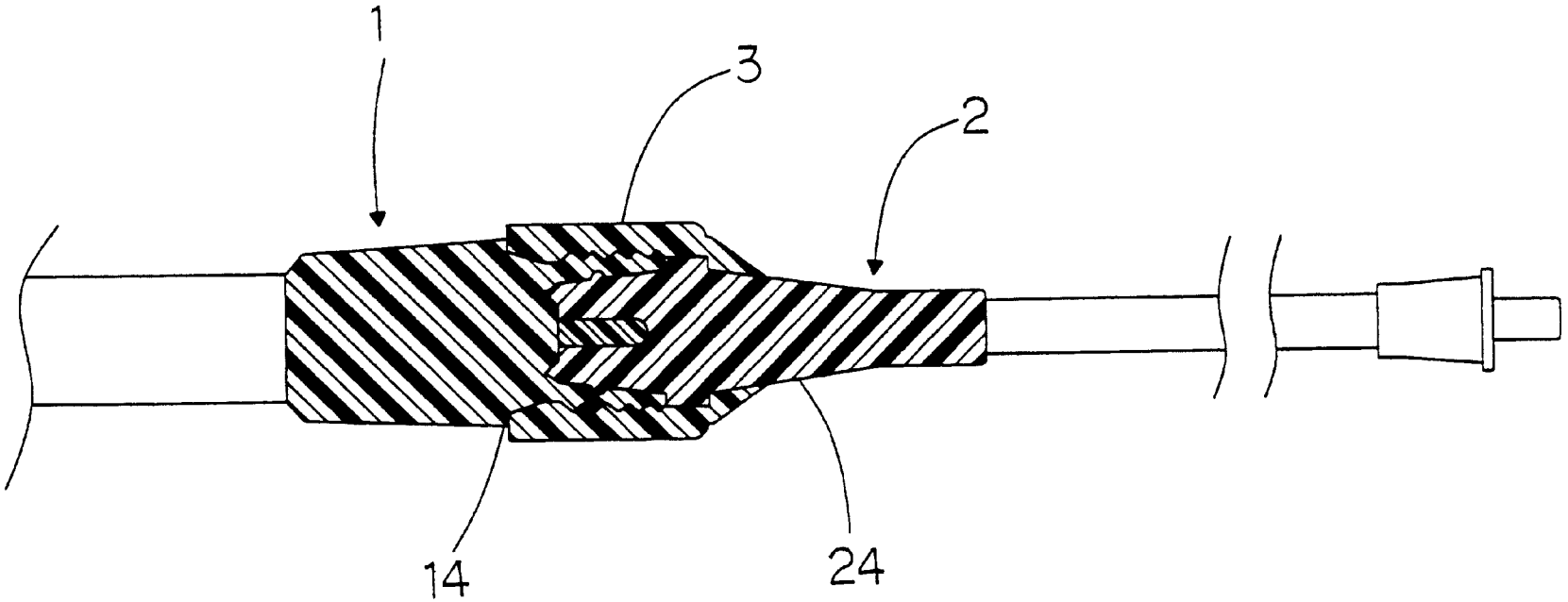
FIG. 3 is a schematic, cross-sectional, lateral view drawing of the assembly of the present invention.

According to the abovementioned, when the negative joint (2) of the electric cord is connected into the positive joint (1) of the rope light, as shown in FIG. 3, the convex retaining ring (23) disposed on the negative joint (2) of the electric cord tightly retains the concave groove retaining ring (15) inside the jointing plane (11) of the positive joint (1) of the rope light so as to make both of the positive joint (1) of the rope light and the negative joint (2) of the electric cord not easy to loosen or detach; the V-shaped slot (12) inside the positive joint (1) of the rope light and the cone-shaped head (22) of the negative joint (2) of the electric cord also tightly engage each other; in addition, the jointing planes (11, 21) of the positive joint (1) of the rope light and the cone-shaped head (22) of the negative joint (2) of the electric cord also tightly connect with each other to make the rope light 100% waterproof.

According to the abovementioned, in order to reinforce the strength of extension between the positive joint (1) of the rope light and the negative joint (2) of the electric cord, the present invention further uses a nut (3) to tightly lock the positive joint (1) of the rope light and the negative joint (2) of the electric cord; at this time, the contacting planes (14, 24) of the positive joint (1) of the rope light and the negative joint (2) of the electric cord jointing with the left and the right hole areas of the nut (3) tightly engage with the jointing planes (11, 21) of the positive joint (1) of the rope light and the negative joint (2) of the electric cord to additionally reinforce the waterproof effect of the present invention.

In summation of the abovementioned, the present invention of a waterproof structure of a rope light truly possesses the economic efficiency of being more convenient and safe is innovative and advanced. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A waterproof structure of a rope light is to reinforce the waterproof effect of the joint between a positive joint of the rope light and a negative joint of an electric cord; is characterized that screw threads are disposed on an outer rim of the positive joint of said rope light; a V-shaped slot disposed concavely on a circumferential rim of a bottom portion of a jointing plane inside a positive joint of the rope light joints correspondingly with a cone-shaped head disposed convexly on a circumferential rim of a bottom portion of a jointing plane of a negative joint of the electric cord; in addition, a convex retaining ring disposed at a proper area of the negative joint of the electric cord tightly retains with a concave groove retaining ring disposed on the circumferential rim of the jointing plane inside the positive joint of the rope light; furthermore, a nut inserted on the negative joint of the electric cord screws fixedly with the screw threads disposed on the outer rim of the positive joint of the rope light to prevent liquid permeation, such as water and to eliminate the short circuit and damage of the rope light; all of the respectively jointed and fixedly screwed jointing planes of the positive joint of the rope light, the negative joint of the electric cord and the nut are of beveled shapes for facilitating the assembly and reinforcing waterproof effect.

* * * * *